US008201960B2

(12) United States Patent
Ortega

(10) Patent No.: US 8,201,960 B2
(45) Date of Patent: Jun. 19, 2012

(54) CHILDREN'S BOOK LIGHT

(76) Inventor: Gonzalo Chris Ortega, Green Valley, AZ (US)

( * ) Notice: Subject to any disclaimer, the term of this patent is extended or adjusted under 35 U.S.C. 154(b) by 258 days.

(21) Appl. No.: 12/753,783

(22) Filed: Apr. 2, 2010

(65) Prior Publication Data

US 2011/0242798 A1 Oct. 6, 2011

(51) Int. Cl.
*A47B 19/00* (2006.01)

(52) U.S. Cl. ..... 362/99; 362/98; 362/191; 362/198; 362/372; 362/396

(58) Field of Classification Search ..... 362/98, 362/124, 190–191, 198, 220, 253, 372, 396, 362/800, 806, 99; 116/234, 237–239
See application file for complete search history.

(56) References Cited

U.S. PATENT DOCUMENTS 5,884,888 A * 3/1999 Grimes et al. ..... 248/441.1
2008/0232098 A1* 9/2008 Nelson et al. ..... 362/191

* cited by examiner

*Primary Examiner* — Stephen F Husar
*Assistant Examiner* — Meghan Dunwiddie
(74) *Attorney, Agent, or Firm* — Morgan Law Offices, PLC

(57) ABSTRACT

A children's book light comprises a head, the head including a light source for illuminating at least one page of a book; a body, the body including a page holder for holding open a page of the book; and a flexible neck, the flexible neck connecting the head to the body. Preferably, the head represents the head of a fictional character or an animal. Preferably, the page holder includes a pair of arms capable of holding the book open to a selected page. Preferably, the flexible neck is constructed of metal, most preferably, gooseneck tubing. Preferably, the light source includes a light emitting diode (LED), and the body includes at least one battery, the at least one battery electrically connected to the LED situated in the head via wiring, the wiring passing through the flexible neck from the battery to the LED. Preferably, the flexible neck is structured and arranged to allow the head to move relative to the body. Preferably, when the head is moved downwardly relative to the body, a portion of the flexible neck retracts into the head. Preferably, the body includes a detachable book mark, the detachable book mark separately useable. Preferably, the children's book light includes a switch located in the head that can be toggled by squeezing the head.

18 Claims, 5 Drawing Sheets

FIG. 2(a)
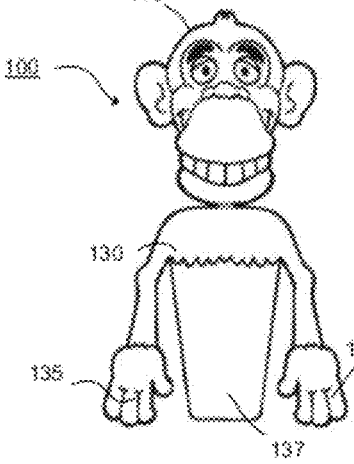
FIG. 2(b)
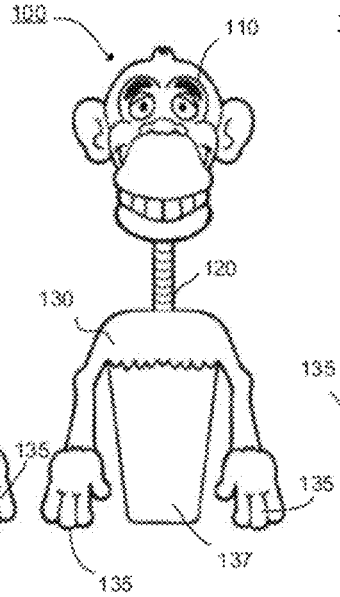
FIG. 2(c)
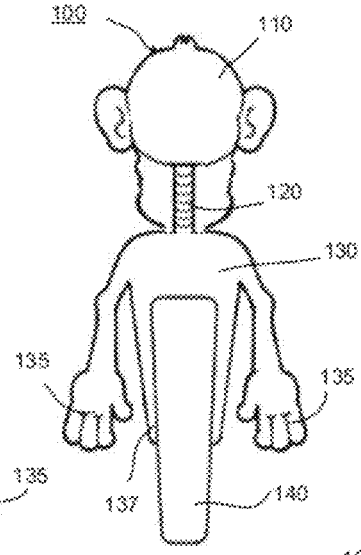
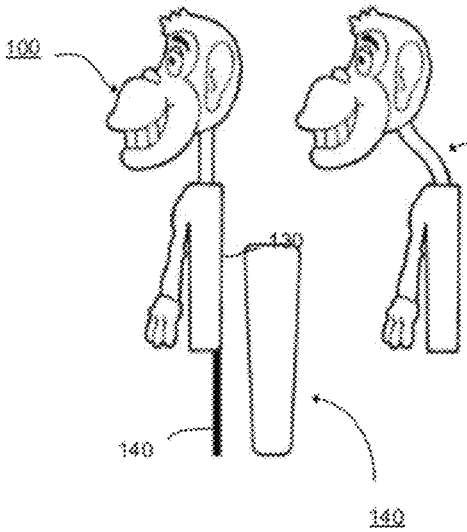
FIG. 2(d)
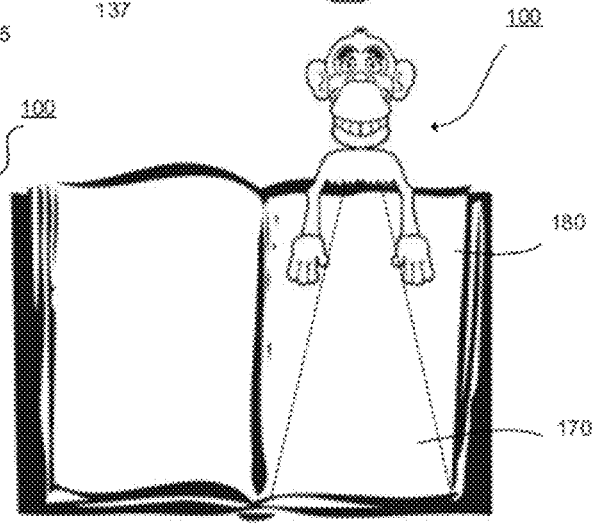
FIG. 2(e)

CHILDREN'S BOOK LIGHT

FIELD OF THE INVENTION

The present invention relates to portable illuminating devices, and, more particularly to a children's book light in the form of a fictional character or an animal.

BACKGROUND

Various devices have been created to supply lighting for adult readers. For example, U.S. Pat. No. D395,723 to Zeller discloses a design for a book light that clips onto a book cover and includes a telescoping lighting arm. Another such patent is U.S. Pat. No. 7,163,306 to Major et al. which discloses a book light that attaches to the spine of a book. While such inventions are useful to adult readers, these book lights are not attractively designed for the young reader.

SUMMARY OF THE INVENTION

A children's book light comprises a head, the head including a light source for illuminating at least one page of a book; a body, the body including a page holder for holding open a page of the book; and a flexible neck, the flexible neck connecting the head to the body. Preferably, the children's book light is in the form of a fictional character or an animal. Preferably, the page holder includes a pair of arms capable of holding the book open to a selected page.

Preferably, the flexible neck is constructed of metal, most preferably, gooseneck tubing.

Preferably, the light source includes a light emitting diode (LED), and the body includes at least one battery, the at least one battery electrically connected via wiring to the LED situated in the head, the wiring passing through the flexible neck from the battery to the LED.

Preferably, the flexible neck is structured and arranged to allow the head to move relative to the body. Preferably, when the head is moved downwardly relative to the body, a portion of the flexible neck retracts into the head.

Preferably, the body includes a detachable book mark, the detachable book mark separately useable.

Preferably, the children's book light includes a switch located in the head that can be toggled by squeezing the head.

These and other aspects, features, and advantages of the present invention will become apparent from the following detailed description of preferred embodiments, which is to be read in connection with the accompanying drawings.

BRIEF DESCRIPTION OF THE DRAWINGS

FIGS. 2(*a*) to 2(*c*) show the flexible neck of the children's book light in various positions;

FIG. 2(*d*) shows the detachable book mark feature of the children's book light;

FIG. 2(*e*) shows the children's book light positioned to hold open a page of a book and provide lighting;

DETAILED DESCRIPTION

Figure 1:
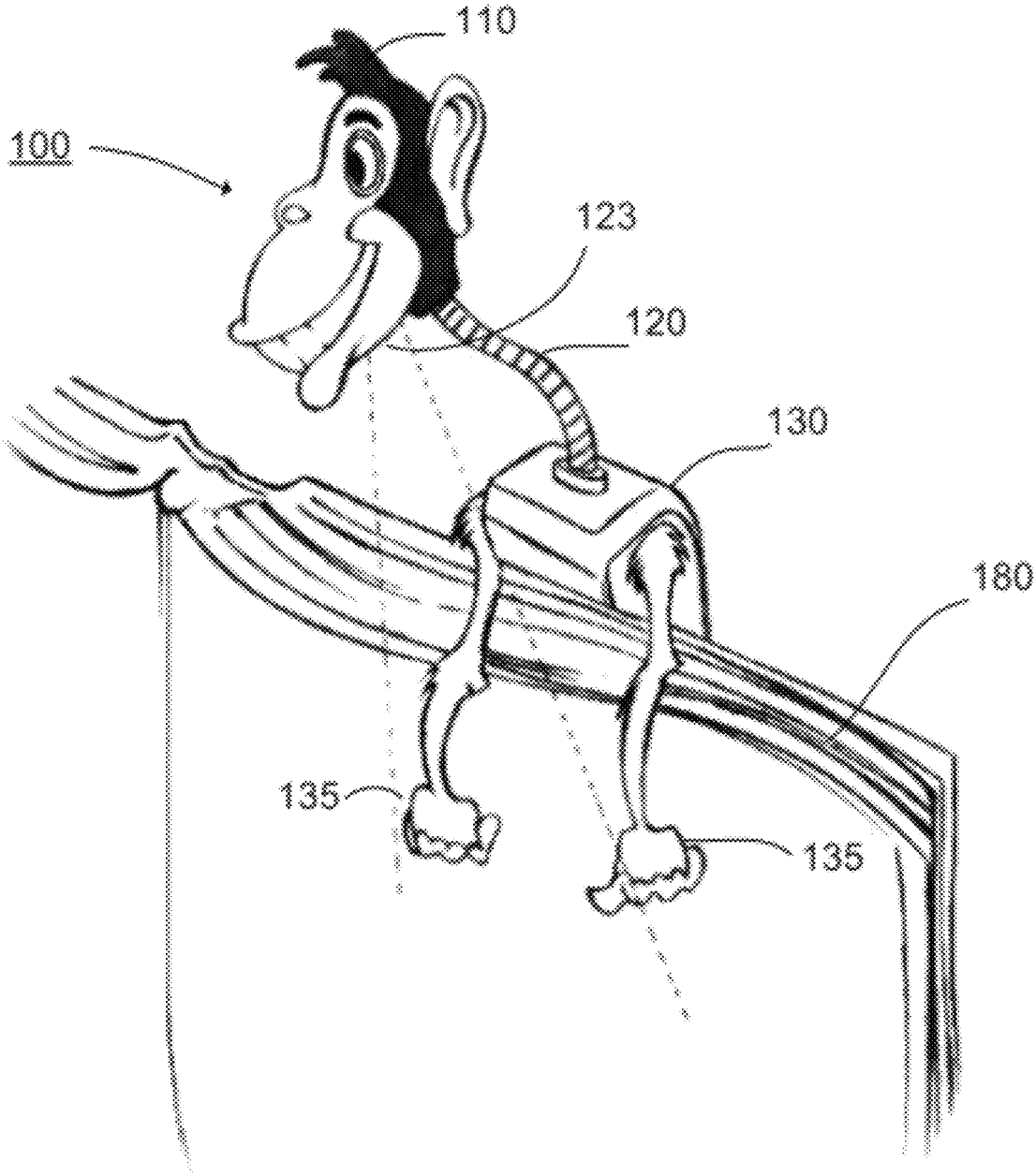
FIG. 1 shows an example of a children's book light according to a preferred embodiment of the present invention.

FIG. 1 illustrates an example of a children's book light 100 according to a preferred embodiment of the present invention.

As shown, the children's book light 100 is in the form of a monkey. However, it is to be appreciated that the children's book light 100 could be in the form of various other animals or fictional characters, such as, for example, a rabbit, a bear, a giraffe, a cartoon character, a dragon, an alien, etc. In general, the animal or character chosen for the children's book light 100 should be attractive to children. That way, the book light 100 would be more likely to be used.

As illustrated, the children's book light 100 includes a head 110, a body 130, and a flexible neck 120, wherein, in this example, the head 110 looks like a monkey's head, the body 130 looks like a monkey's body, and the flexible neck 120 looks like a monkey's neck. According to this embodiment, the body 100 includes a page holder 135 (in the form of a pair of monkey hands) capable of holding open a book 180 to a particular page. Additionally, the children's book light 100 includes a light source 123, preferably a light emitting diode (LED) positioned in the lower portion of the head 110. With the children's book light 100 positioned on the book 180, the children's book light 100 can be adjusted so that the page being read is sufficiently illuminated by moving the flexible neck 120 to the proper position. Preferably, the flexible neck 120 is constructed of a material such that once bent, the flexible neck 120 stays in that position. Preferably, the flexible neck will be constructed of a flexible tubing, most preferably, metal gooseneck tubing.

In operation, the children's book light 100 is positioned atop an open book 180, and is "clipped" onto the book by placement of the open book 180 between the page holder 135 and the main portion of the body 100, as shown. Preferably, the page holder 135 will tightly hold the book 180 open no matter how few pages are being held. To accomplish this, the page holder 135 will, preferably, act as tension clip.

FIGS. 2(*a*) to 2(*c*) illustrate the flexible neck 120 of the children's book light 100 in various positions. In particular, FIG. 2(*a*) shows the flexible neck 120 completely retracted into the head 100, such that the head 110 touches the body 130 with the flexible neck 120 not being visible. The head 110 will have a hollow slit to accommodate sliding the flexible neck 120 into the head 110. FIG. 2(*b*) shows the flexible neck 120 in a raised position. In this case, the flexible neck 120 can be moved in different directions, which is especially helpful to adjust the direction of the light source 123. FIG. 2(*c*) shows the back of the flexible neck 120 in a raised position. In this view, a detachable book mark 140 is shown attached to the body 130. FIG. 2(*d*) shows side views of the children's book light 100 in which the book mark 140 is removed from the body 130. Preferably, the book mark 140 is made of a flat plastic material and is attachable to the body 130 by sliding the book mark 140 into grooves (not shown) on the back of the body. However, it is to be understood that the book mark 140 could be made of other materials (e.g., metal) and be held onto the body 130 by other means (e.g., a magnet).

Figure 3A:
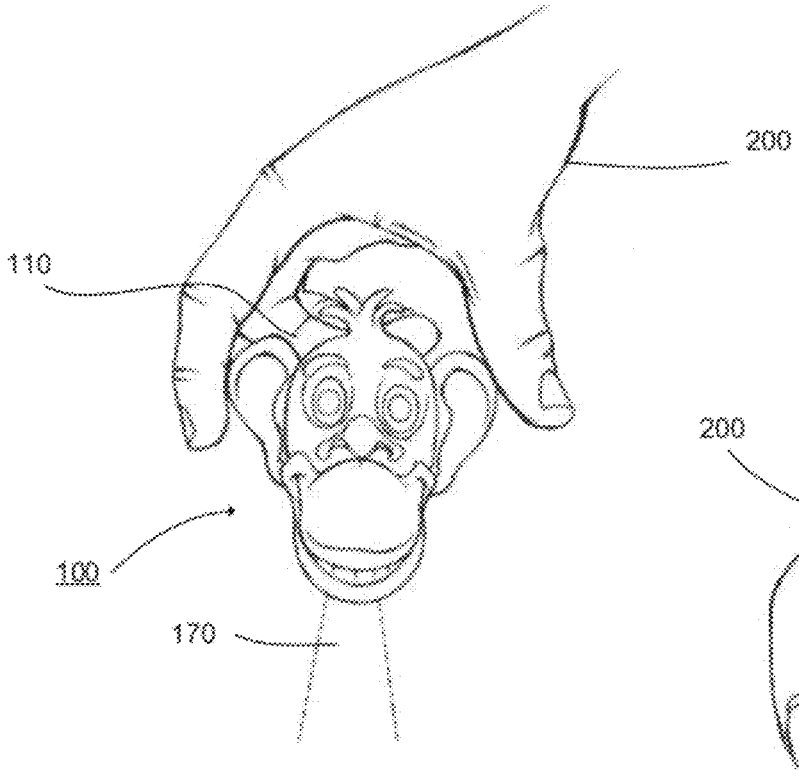
FIGS. 3(*a*) and 3(*b*) show a person squeezing the head of the children's book light to toggle a light switch in the head.
Figure 3B:
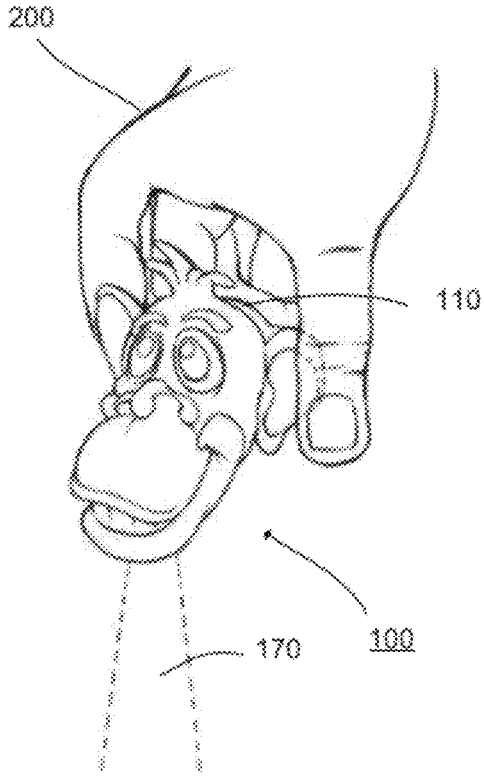

FIGS. 3(*a*) and 3(*b*) show a person squeezing the head 110 of the children's book light 100 to toggle a light switch. As will be described in greater detail, to accomplish this, the head 110 will, preferably, be constructed of a soft plastic material that can be easily squeezed, and inside the head will be a push-button toggle switch 115 that can alternatively activate/deactivate the light source 123, responsive to the head 110 being squeezed.

Figure 4:
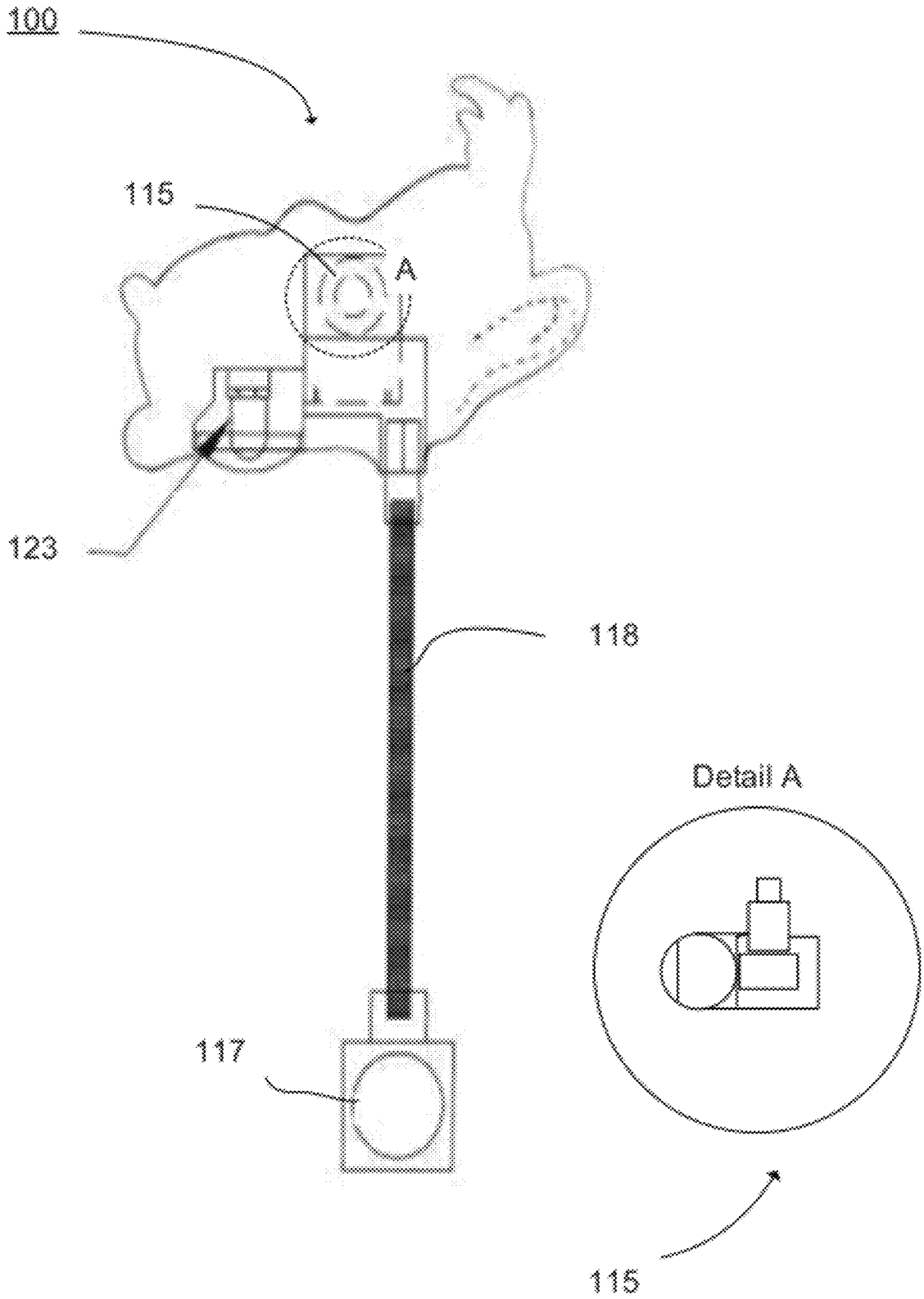
FIG. 4 shows the electrical components of the children's book light.

FIG. 4 shows the electrical components of the children's book light 100. As illustrated, the light source 123 is electrically connected to a power source 117, via wiring 118. Preferably, the light source 123 includes an LED and the power supply includes a 9-volt DC battery. Preferably, the wiring 118 includes a pair of wires, a first wire of the pair connected to the negative terminal of the power source 117 and a second wire of the pair connected to the positive terminal of the power source 117. Preferably, the first wire is connected to the push-button toggle switch 115 which electrically is connected to the negative contact of the light source 123 and the opposite end of the second wire is connected to the positive contact of the light source 123. (It is to be appreciated that the push-button toggle switch 115 could be disposed on the second wire between the positive contact of the light source 123 and positive terminal of the power source 117). Preferably, the push-button toggle switch 115 is held firmly in place inside the head 110 using a mounting bracket, as shown. Preferably, the push-button toggle switch 115 is attached to the mounting bracket by a plurality of screws or using glue and is positioned so that it can be toggled easily by squeezing of the head 110.

Detail A shows an example of the push-button toggle switch 115. Suitable push-button toggle switches for use in conjunction with the present invention include the Mini SPDT 3-Amp On/Push Off Switch, Model No. 275-155, distributed by RadioShack Corporation. Suitable LED for use in conjunction with the present invention include the 5 mm White LED, Model No. 276-320, distributed by RadioShack Corporation. Suitable batteries for use in conjunction with the present invention include ENERCELL™ CR1220 3v/38Ah Lithium Button Cell battery, Model No. CR1220, distributed by RadioShack Corporation.

Figure 5:
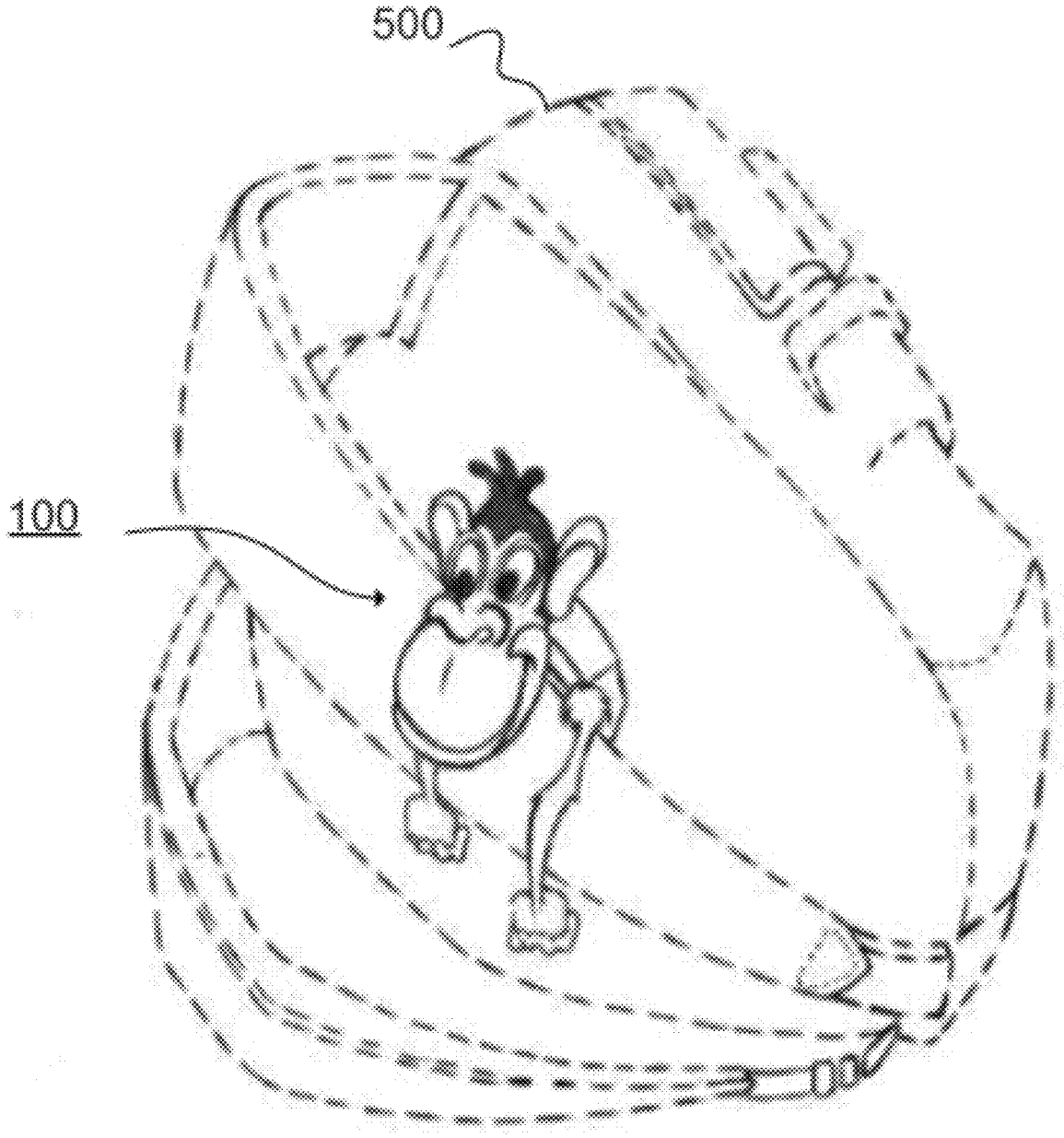
FIG. 5 shows the children's book light attached to a school bag.

FIG. 5 shows the children's book light 100 attached to a school bag 500. As illustrated, the children's book light 100 can be easily carried when not in use and can be used as toy. It is to be understood that the children's book light 100 can be attached to various other objects and can be made in the form of many different animals or fictional characters, including popular characters found attractive by a large population of young persons.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A children's book light, comprising:

a head, the head including a light source for illuminating at least one page of a book;

a body, the body including a page holder for holding open a page of the book and a detachable book mark, the detachable book mark separately useable; and a flexible neck, the flexible neck connecting the head to the body.

2. The children's book light of claim 1, wherein the head depicts a plurality of facial features.

3. The children's book light of claim 2, wherein the depicted facial features include one or more of a pair of eyes, a mouth, a nose, and a pair of ears.

4. The children's book light of claim 1, wherein the head represents the head of an animal.

5. The children's book light of claim 1, wherein the head represents the head of a cartoon character.

6. The children's book light of claim 1, wherein the page holder includes a pair of arms.

7. The children's book light of claim 6, wherein the pair of arms are capable of holding the book open to a selected page.

8. The children's book light of claim 1, wherein the flexible neck is constructed of gooseneck tubing.

9. The children's book light of claim 8, wherein the gooseneck tubing is metal.

10. The children's book light of claim 1, wherein the light source includes a light emitting diode (LED).

11. The children's book light of claim 1, wherein the body includes at least one battery, the at least one battery electrically connected to a lamp situated in the head via wiring, the wiring passing through the flexible neck from the battery to the lamp.

12. The children's book light of claim 1, wherein the flexible neck allows the head to move relative to the body.

13. The children's book light of claim 12, wherein, when the head is moved downwardly relative to the body, a portion of the flexible neck retracts into the head.

14. The children's book light of claim 1, wherein the device includes a switch.

15. The children's book light of claim 14, wherein the switch is located in the head and can be toggled by squeezing the head.

16. A children's book light, comprising:

a head, the head including light for illuminating at least one page of a book;

a body, the body including a page holder for holding a page of the book and a detachable book mark, the detachable book mark separately useable; and a flexible neck, the flexible neck constructed of gooseneck tubing, connecting the head to the body;

wherein the head includes a switch therein that can be toggled by squeezing the head.

17. The children's book light of claim 16, wherein the head depicts the head of a whimsical character.

18. The children's book light of claim 16, wherein, when the head is moved downwardly relative to the body, a portion of the flexible neck retracts into the head.

* * * * *